US011302159B2

(12) United States Patent
Liao et al.

(10) Patent No.: US 11,302,159 B2
(45) Date of Patent: Apr. 12, 2022

(54) LOGISTICS APPLIANCE AND ANTI-DISASSEMBLY METHOD THEREFOR

(71) Applicant: SHANGHAI HONGYAN RETURNABLE TRANSIT PACKAGINGS CO., LTD., Shanghai (CN)

(72) Inventors: Qingxin Liao, Shanghai (CN); Bo Li, Shanghai (CN); Yiwen Cao, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 16 days.

(21) Appl. No.: 16/955,650

(22) PCT Filed: Dec. 19, 2018

(86) PCT No.: PCT/CN2018/121920
§ 371 (c)(1),
(2) Date: Jun. 18, 2020

(87) PCT Pub. No.: WO2019/120203
PCT Pub. Date: Jun. 27, 2019

(65) Prior Publication Data

US 2020/0388124 A1 Dec. 10, 2020

(30) Foreign Application Priority Data

Dec. 20, 2017 (CN) ..... 201711387618.8

(51) Int. Cl.
*G08B 13/18* (2006.01)
*G08B 13/189* (2006.01)
*G08B 25/10* (2006.01)

(52) U.S. Cl.
CPC ..... *G08B 13/1895* (2013.01); *G08B 25/10* (2013.01)

(58) Field of Classification Search
CPC ..... G08B 13/1895; G08B 25/10
(Continued)

(56) References Cited

U.S. PATENT DOCUMENTS 4,140,915 A * 2/1979 Rube ..... G03B 1/60 250/570
5,506,567 A * 4/1996 Bichlmaier ..... B60R 25/1004 340/555

(Continued)

FOREIGN PATENT DOCUMENTS

CN 203025353 U 6/2013
CN 203038313 * 7/2013

(Continued)

OTHER PUBLICATIONS

International Search Report issued in International Application No. PCT/CN2018/121920, dated Mar. 19, 2019, 4 pages with translation.

(Continued)

*Primary Examiner* — Kerri L McNally
*Assistant Examiner* — Thang D Tran
(74) *Attorney, Agent, or Firm* — Hamre, Schumann, Mueller & Larson, P.C.

(57) ABSTRACT

The present application relates to the field of logistics, discloses an anti-disassembly logistics appliance and anti-disassembly method therefor, realizing the anti-disassembly alarm of a designated module under the premise of simple structure and low power consumption. An anti-disassembly logistics appliance, comprising: a confined space and an anti-disassembly module disposed in the confined space; the anti-disassembly module comprises: one or more photoelec- (Continued)

tric devices, a wireless communication unit and a determining unit; the determining unit is configured to determine whether an electrical signal output by the photoelectric device is greater than a preset threshold, and if so, triggers the wireless communication unit to transmit an alarm signal; the structure of the confined space satisfies following requirements: the confined space is an light-tight dark space after the anti-disassembly module is installed; during the process of disassembling the anti-disassembly module from the logistics appliance, the light-tightness of the confined space is at least temporarily destroyed to enable the opto-electronic device to detect light.

11 Claims, 3 Drawing Sheets

(58) Field of Classification Search
USPC ..... 340/555
See application file for complete search history.

(56) References Cited

U.S. PATENT DOCUMENTS 6,104,307 A * 8/2000 Hanratty ..... G08B 13/1481 340/571
7,128,308 B2 * 10/2006 Marsh ..... E01F 13/12 256/13.1
9,460,593 B2 * 10/2016 Acosta ..... G08B 13/08
2002/0047904 A1 * 4/2002 Okada ..... H04N 1/0018 348/207.99
2004/0058476 A1 * 3/2004 Enquist ..... B81C 1/00269 438/114
2004/0160309 A1 * 8/2004 Stilp ..... G06K 19/0701 340/10.2
2005/0232747 A1 * 10/2005 Brackmann ..... B60P 3/14 414/803
2008/0297346 A1 * 12/2008 Brackmann ..... B60P 3/14 340/572.1
2010/0201348 A1 * 8/2010 Wan ..... G01R 22/065 324/142
2010/0258343 A1 * 10/2010 Hsu ..... H05K 1/0218 174/350
2014/0305828 A1 * 10/2014 Salvo ..... G08B 13/1654 206/459.1
2015/0023023 A1 * 1/2015 Livesay ..... H01L 33/50 362/294
2015/0077256 A1 * 3/2015 Maddox ..... G06Q 10/08 340/572.1
2016/0261089 A1 * 9/2016 Felder ..... H01S 5/02257
2017/0228992 A1 * 8/2017 Carlson ..... G08B 5/36

FOREIGN PATENT DOCUMENTS

CN 203038313 U 7/2013
CN 204423568 * 6/2015
CN 204423568 U 6/2015
CN 204587782 U 8/2015
CN 207571852 U 7/2018
JP 2002065975 * 3/2002
JP 2002065975 A 3/2002
JP 2009238166 * 10/2009
JP 2009238166 A 10/2009
WO 2014/152735 9/2014

OTHER PUBLICATIONS

Office Action issued in corresponding Japanese Application No. 2020-534351, dated Aug. 17, 2021, with English translation.

* cited by examiner

LOGISTICS APPLIANCE AND ANTI-DISASSEMBLY METHOD THEREFOR

TECHNICAL FIELD

The application relates to the field of logistics, in particular to an anti-disassembly technology of accessory modules of logistics appliances.

BACKGROUND

Recyclable logistics appliances are reusable logistics appliances. In order to be able to better manage the recyclable logistics appliances, it is necessary to install smart module in the recyclable logistics appliances. The smart module usually comprises a wireless communication device, a sensor, a location device, etc., and can upload the current position and various states of the recyclable logistics appliance to a cloud server.

However, the effective management of the recyclable logistics appliances by smart module relies on a premise that it must ensure that the smart module is correctly installed in the recyclable logistics appliance. If someone intentionally disassembles the smart module from the recyclable logistics appliance, the smart module will continue working with the support of its battery, but the information (including position information, etc.) that it returns is incorrect.

Therefore, how to alarm in time when the smart module is disassembled from the recyclable logistics appliance becomes a problem to be solved.

A traditional solution is to cut off an anti-theft circuit when the relevant anti-theft screw is disassembled. The structure of this solution is complicated (needs to lead wires to the anti-theft screw), and is difficult to install, and its reliability is low.

Another traditional solution is to use infrared ray for anti-theft. The traditional infrared ray for anti-theft requires male and female terminals, and needs to continuously transmit infrared ray, which is too high-power consumption for non-rechargeable and long working hours.

SUMMARY OF THE INVENTION

The purpose of this application is to provide a logistics appliance and anti-disassembly method therefor, which realizes anti-disassembly alarm of the designated module under the premise of simple structure and low power consumption.

In order to solve the above problems, the present application discloses an anti-disassembly logistics appliance, comprising: a confined space and an anti-disassembly module disposed in the confined space;

the anti-disassembly module comprises: one or more photoelectric devices, a wireless communication unit and a determining unit; the determining unit is configured to determine whether an electrical signal output by the photoelectric device is greater than a preset threshold, and if so, triggers the wireless communication unit to transmit an alarm signal;

the structure of the confined space satisfies following requirements:

the confined space is an light-tight dark space after the anti-disassembly module is installed; and, during the process of disassembling the anti-disassembly module from the logistics appliance, the light-tightness of the confined space is at least temporarily destroyed to enable the optoelectronic device to detect light.

In a preferred embodiment, the anti-disassembly module further comprises one or any combination of the following components electrically coupled to the wireless communication unit:

a temperature sensor, a humidity sensor, an acceleration sensor, a gyroscope, a logistics appliance empty/full sensor;

the wireless communication unit accesses an external wireless communication network in a wireless manner, and transmits signals output by the above sensors together with an identification of the anti-disassembly module to a cloud server through the wireless communication network.

In a preferred embodiment, the alarm signal comprises one of the following information or any combination thereof:

an identification of the anti-disassembly module, an identification of the logistics appliance, the time when the alarm is triggered, and the position where the alarm is triggered.

In a preferred embodiment, the anti-disassembly module comprises an independent battery to supply power to the photoelectric device, the wireless communication unit and the determining unit.

In a preferred embodiment, further comprising a wireless charging module coupled to the battery for charging the battery.

In a preferred embodiment, the confined space is a cavity, and the inner surface of the cavity is made of a material with a reflection coefficient lower than a predetermined threshold.

In a preferred embodiment, the inner surface of the cavity is made of black matte material.

In a preferred embodiment, after the anti-disassembly module is installed in the confined space, at least one surface of the anti-disassembly module is used as a bonding surface to be bonded to one surface of the logistics appliance, and at least one surface is used as a non-bonding surface which is in the confined space but not bonded to any surface of the logistics appliance;

there are a plurality of the photoelectric devices, at least one photoelectric device is disposed on the bonding surface, and at least one photoelectric device is disposed on the non-bonding surface;

the determining unit is configured to trigger the wireless communication unit to transmit an alarm signal indicating that the anti-disassembly module is completely disengaged if the electrical signal output by the photoelectric device disposed on the bonding surface is greater than a preset threshold, and trigger the wireless communication unit to transmit an alarm signal indicating that the anti-disassembly module is damaged if the electrical signal output by the photoelectric device disposed on the non-bonding surface is greater than a preset threshold.

This application also discloses an anti-disassembly method for logistics appliance, comprising:

installing an anti-disassembly module into a logistics appliance in advance so that the anti-disassembly module is disposed in a confined space structure;

determining that an electrical signal indicating optical intensity output by a photoelectric device is greater than a preset threshold;

triggering a wireless communication unit to transmit an alarm signal;

wherein, the structure of the confined space satisfies following requirements:

the confined space is an light-tight dark space after the anti-disassembly module is installed; and, during the process of disassembling the anti-disassembly module from the logistics appliance, the light-tightness of the confined space is at least temporarily destroyed to enable the optoelectronic device to detect light.

In a preferred embodiment, further comprising:

before legal disassembly, sending an instruction indicating suspending alarm from a server to the anti-disassembly module;

prohibiting the wireless communication unit from transmitting the alarm signal after the anti-disassembly module receives the instruction.

In a preferred embodiment, further comprising:

sending a request which carries the identification of the anti-disassembly module or the logistics appliance for legal disassembly to a server through a terminal;

ignoring the alarm signal which carries the identification of the anti-disassembly module or the logistics appliance after the server receives the request in the received alarm signal.

Compared with the prior art, the embodiments of the present application have at least the following differences and effects:

Installing the photoelectric device and the wireless communication unit in the anti-disassembly module, and then installing the anti-disassembly module into the light confined space of the logistics appliance. When the anti-disassembly module is disassembled, the light-tightness of the light confined space is destroyed, and the photoelectric device will detect sufficient optical intensity and trigger the wireless communication unit to transmit an alarm signal, thereby achieves a reliable anti-disassembly alarm with simple structure, and needs low power consumption in daily monitoring.

A large number of technical features are described in the specification of the present application, and are distributed in various technical solutions. If a combination (i.e., a technical solution) of all possible technical features of the present application is listed, the description may be made too long. In order to avoid this problem, the various technical features disclosed in the above summary of the present application, the technical features disclosed in the various embodiments and examples below, and the various technical features disclosed in the drawings can be freely combined with each other to constitute various new technical solutions (all of which are considered to have been described in this specification), unless a combination of such technical features is not technically feasible. For example, feature A+B+C is disclosed in one example, and feature A+B+D+E is disclosed in another example, while features C and D are equivalent technical means that perform the same function, and technically only choose one, not to adopt at the same time. Feature E can be combined with feature C technically. Then, the A+B+C+D scheme should not be regarded as already recorded because of technical infeasibility, and A+B+C+E scheme should be considered as already documented.

DETAILED DESCRIPTION

Figure 1:
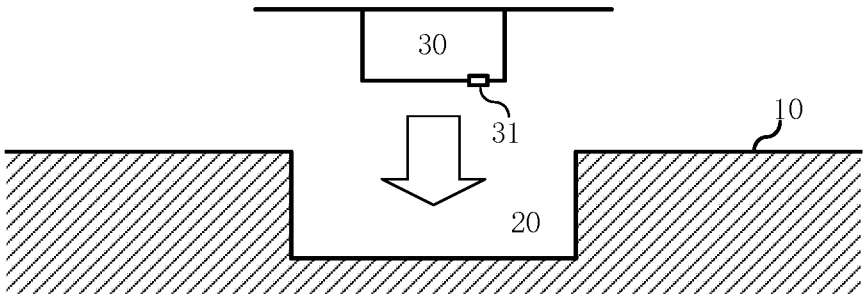
FIG. 1 is a schematic structural view of an anti-disassembly logistics appliance before assembling to form a confined space in a first embodiment of the present invention.

In the following description, numerous technical details are set forth in order to provide the reader with a better understanding of the present application. However, those skilled in the art can understand that the technical solutions claimed in the present application can be implemented without these technical details and various changes and modifications based on the following embodiments.

The following is a summary of some of the innovations of this application:

In the present invention, an anti-disassembly module (that is, a module that needs to be protected against disassembly) is installed into a light-tight confined space of a logistics appliance, and the anti-disassembly module is provided with a photoelectric device and a wireless communication unit. Under a normal working condition of the logistics appliance and the anti-disassembly module, the confined space will not be opened, and the light-tightness of the confined space will not be destroyed, that is, the confined space should be dark, and the photoelectric device should not detect optical signal (or, at least could not detect sufficient intensity of optical signal). When the anti-disassembly module is disassembled abnormally, in order to disassemble the module, the light-tightness of the confined space must be destroyed (at least partially), so that the photoelectric device could detect sufficient intensity of optical signal (or, the intensity of optical signal exceeds a predetermined threshold), and triggers the wireless communication unit to transmit an alarm signal. The invention cleverly realizes the anti-disassembly protection of the electronic module at a relatively low cost through structural design and detection of optical signal. Considering that under normal circumstances, when the module is illegally disassembled, the illegal disassemble personnel generally need help of light to see its structure to implement the disassembly, so the anti-disassembly protection effect is still very effective.

Preferably, the anti-disassembly module may be provided with a plurality of photoelectric devices, some of the photoelectric devices are disposed on the bonding surface which the logistics appliance is bonded to, and other photoelectric devices are disposed on the non-bonding surface which the logistics appliance is not bonded to. Under normal circumstances, all photoelectric devices are sealed in the confined space, and no optical signal can be detected. If the confined space is destroyed, but the anti-disassembly module is still bonded to the logistics appliance, the photoelectric devices disposed on the bonding surface still cannot detect sufficient intensity of optical signal, while the photoelectric devices disposed on the non-bonding surface will detected sufficient intensity of optical signal and output an electrical signal to trigger the wireless communication unit to transmit an alarm signal indicating that the confined space is damaged. If not only the confined space is destroyed, but also the anti-disassembly module is disassembled from the logistics appliance, the photoelectric devices disposed on the bonding surface will also detect sufficient intensity of optical signal to output an electrical signal to trigger the wireless communication unit to transmit an alarm signal indicating that the anti-disassembly module is completely disengaged. Through this design, a cloud server can be aware of detailed status of the anti-disassembly module, so as to better cope with it. For example, if it is only an alarm signal indicating that the confined space is damaged, you only need to send a maintenance engineer to repair it, if it is an alarm signal indicating that the anti-disassembly module is completely disengaged, you need to further confirm whether you need to report to the local police.

In order to make the objects, technical solutions and advantages of the present application more clear, embodiments of the present application will be further described in detail below with reference to the accompanying drawings.

Figure 2:
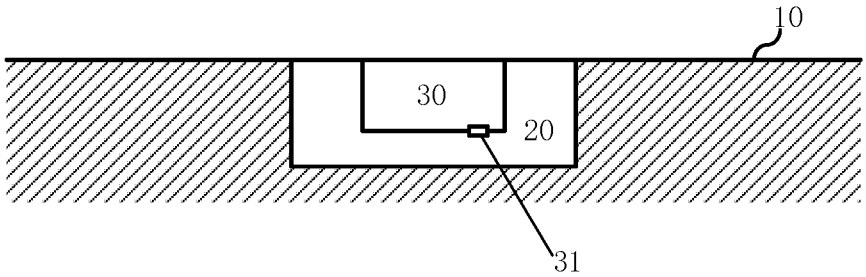
FIG. 2 is a schematic structural view of an anti-disassembly logistics appliance after assembling to form a confined space in the first embodiment of the present invention.

The first embodiment of the present invention relates to an anti-disassembly logistics appliance. FIG. 1 is a schematic structural view of the anti-disassembly logistics appliance before assembling, and FIG. 2 is a schematic structural view of the anti-disassembly logistics appliance after assembling to form a confined space. The anti-disassembly logistics appliance 10 comprises a confined space 20 and an anti-disassembly module 30 disposed in the confined space 20.

Figure 3:
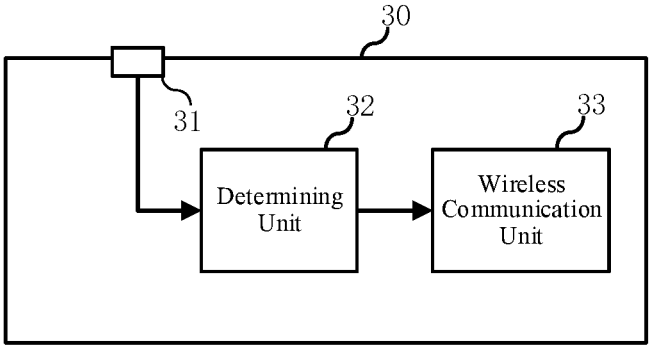
FIG. 3 is a schematic structural view of the anti-disassembly module in the first embodiment of the present invention.

The structure of the anti-disassembly module 30 is shown in FIG. 3 and comprises one or more photoelectric device 31, a determining unit 32 and a wireless communication unit 33. The determining unit 32 is used to determine whether the electrical signal output by the photoelectric device 31 is greater than a preset threshold, and if so, triggers the wireless communication unit 33 to transmit an alarm signal.

The structure of the confined space satisfies the following requirements: the confined space is a light-tight dark space after the anti-disassembly module is installed, and during the process of disassembling the anti-disassembly module from the logistics appliance, the light-tightness of the confined space is at least temporarily destroyed to enable the optoelectronic device to detect light. The confined space is a space for anti-disassembly modules, not a space where the recyclable logistics appliance is loaded with cargo. The normal work of the recyclable logistics appliance (loading, unloading, and storing cargo) will not affect the light-tightness of the confined space.

Installing the photoelectric device and the wireless communication unit in the anti-disassembly module, and then installing the anti-disassembly module into the light confined space of the logistics appliance. When the anti-disassembly module is disassembled, the light-tightness of the light confined space is destroyed, and the photoelectric device will detect sufficient optical intensity and trigger the wireless communication unit to transmit an alarm signal, thereby achieves a reliable anti-disassembly alarm with simple structure, and because the light to be detected is external, it does not transmit light by itself like the traditional infrared detection scheme, so the power consumption required by the anti-disassembly module in daily monitoring is very small, and it can maintain long-term work without charging.

Figure 4:
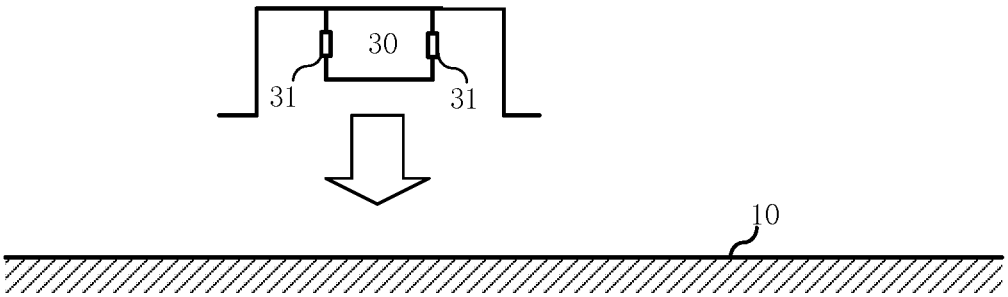
FIG. 4 is a schematic structural view of another anti-disassembly logistics appliance before assembling to form a confined space in the first embodiment of the present invention.
Figure 5:
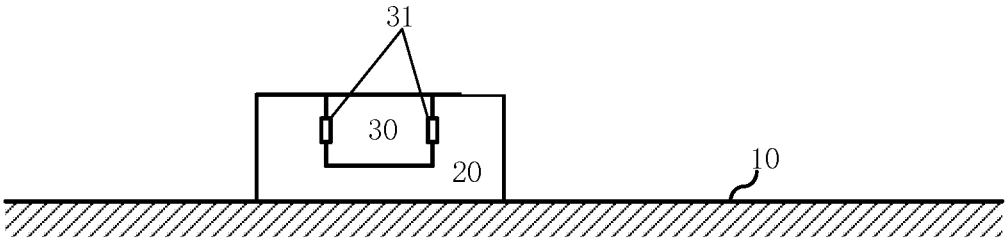
FIG. 5 is a schematic structural view of another anti-disassembly logistics appliance after assembling to form a confined space in the first embodiment of the present invention.

The combination method of the logistics appliance and the anti-disassembly module can be various. In addition to the structures shown in FIG. 1 and FIG. 2, they can also be the structures shown in FIG. 4 and FIG. 5, or other structures, as long as the anti-disassembly module is installed into the logistics appliance, and the anti-disassembly module can be in a confined space.

The method of installing the anti-disassembly module into the recyclable logistics appliance can be various. Optionally, fasteners (such as screws or rivets) are used to fix the anti-disassembly module to the surface of the recyclable logistics appliance. Optionally, the anti-disassembly module is sealed in the base of the recyclable logistics appliance by means of plastic sealing. Optionally, glue is used to attach the anti-disassembly module to the surface of the recyclable logistics appliance. Optionally, the anti-disassembly module is snapped into a preset snap slot on the recyclable logistics appliance.

The implementation method of the photoelectric devices can be various. Optionally, the photoelectric device may be a photodiode. Optionally, the photoelectric device may a photovoltaic cell.

The implementation method of the wireless communication unit can be various. Optionally, the wireless communication unit may be a 5G communication module. Optionally, the wireless communication unit may be a WIFI module. Optionally, the wireless communication unit may be a 4G communication module. Optionally, the wireless communication unit may be a Zigbee module.

The implementation method of the determining unit can be various, and may be physically independent, or may be physically combined with other modules. Optionally, the determining unit may be an independent comparator, which compares the output signal of the photoelectric device with a preset level, and outputs a comparison result to the wireless communication unit. Optionally, the determining unit may be an independent processor. An input terminal of the processor obtains the output signal of the photoelectric device. The processor comprises an analog-to-digital converter which performs analog-to-digital conversion on the voltage signal input from the photoelectric sensor. The conversion result is compared with a preset voltage value, and the comparison result is output to the wireless communication unit. Optionally, the determining unit can be combined in the wireless communication unit, or the logic processor device (such as a microprocessor or DSP) in the wireless communication unit is used to realize the function of the determining unit. Of course, the logic processor device in the wireless communication unit also can take on other tasks, such as control during wireless communication.

The wireless communication unit accesses an external wireless communication network in a wireless manner, and transmits signals output by the above components together with an identification of the anti-disassembly module to the cloud server through the wireless communication network.

The alarm signal may comprise one or any combination of the following information:

the identification of the anti-disassembly module, the identification of the logistics appliance, the time when the alarm is triggered, and the position where the alarm is triggered.

The power supply method of the anti-disassembly module may also be various. Optionally, the anti-disassembly module comprises an independent battery to supply power to other components of the anti-disassembly module (comprising the photoelectric device, the wireless communication unit, and the determining unit). Optionally, the anti-disassembly module further comprises a wireless charging module coupled to the battery for charging the battery.

The implementation method of the confined spaces may also be various. Optionally, the confined space may be a cavity, and the inner surface of the cavity is made of a material with a reflection coefficient lower than a predetermined threshold. Optionally, the inner surface of the cavity may be black matte.

The anti-disassembly module may also optionally comprise one or any combination of the following components that are electrically coupled to the wireless communication unit: a temperature sensor, a humidity sensor, an acceleration sensor, a gyroscope, a logistics appliance empty/full sensor, and the like.

The implementation method of the logistics appliance empty/full sensor may also be various. Here are two examples:

Optionally, transforming an original fixed-shape logistics appliance into a foldable form, that is, a rotation mechanism is disposed between each side plate and a base, and the side plates on all sides can be folded toward the base. One advantage of this is that when there is no load, the logistics appliance can be folded to reduce occupied space. Based on foldable, a low-power short-range wireless transmitter module is disposed on a side plate, and a low-power short-range wireless receiver module is correspondingly disposed on the base. The transmitter module transmits identification information of the logistics appliance. If the receiver module can receive the identification, it means that the current logistics appliance is in a folded state or in the empty state. If the receiver module cannot receive the identification, it can be determined that the logistics appliance is in a non-folded state or in the full state (the appliance after unloaded must be folded to save space). The effective communication distance between the wireless transmitter module and the wireless receiver module needs to be set carefully, so that the effective communication distance is less than linear distance between the wireless transmitter module and the wireless receiver module in the full state, and the effective communication distance should be greater than the linear distance between the wireless transmitter module and the wireless receiver module in the empty state. The low-power short-range transmitter module and receiver module disposed on the base and the side plate of the logistics appliance are bound in pair, and will not interfere with each other when the recyclable logistics appliances are stacked.

Optionally, transforming the logistics appliance into a form that stacked in the empty state, and a physical mechanism for stacking in the empty state is disposed in each logistics appliance. A low-power short-range wireless transceiver module is disposed in each logistics appliance for transmitting or receiving predestinate wireless signal. If the wireless transceiver module of a logistics appliance can receive predestinate wireless signal transmitted by other logistics appliance, the logistics appliance can be considered in the empty state, if it cannot receive the predestinate wireless signal transmitted by any other logistics appliance, the logistics appliance can be considered in the full state. There are certain requirements for design of the physical mechanism and position of the low-power short-range wireless transceiver module, that is, in the state that stacked in the empty state, the linear distance between the wireless transceiver modules of two adjacent logistics appliances should be less than the effective communication distance of the wireless transceiver module, while in the full state, the linear distance between the wireless transceiver modules of two adjacent logistics appliances should be greater than the effective communication distance of the wireless transceiver module. If a logistics appliance is in the state that stacked in the empty state, it is considered to be in the empty state. A logistics appliance in the full state cannot usually be stacked in the empty state. If a logistics appliance is in the full state, it is considered to be in the full state, it is because the logistics appliance comprises the physical mechanism for stacking in the empty state, so it is naturally to stack already empty logistics appliances in the empty state to reduce their occupied space. Therefore, the present application skillfully determines the empty/full state of the logistics appliance through the physical mechanism for stacking in the empty state, and setting of the effective communication distance and the disposed position of the low-power short-range wireless transceiver module. Although it may not be able to determine 100% accurately, the accuracy rate is quite high under normal conditions, and it can already meet needs of scheduling of normal logistics.

The above-mentioned low-power short-range wireless transmitter module can be passive, such as a passive RFID tag or NFC tag. At this time, the low-power short-range receiver module is essentially a tag reader. The receiver module transmits radio waves when needing to read, and the passive tag transmits the identification information of the logistics appliance under the induction of the radio wave. The advantage of using passive tags is that no additional power is required on the side plate. Of course, the low-power short-range wireless transmitter module can also be active.

Figure 6:
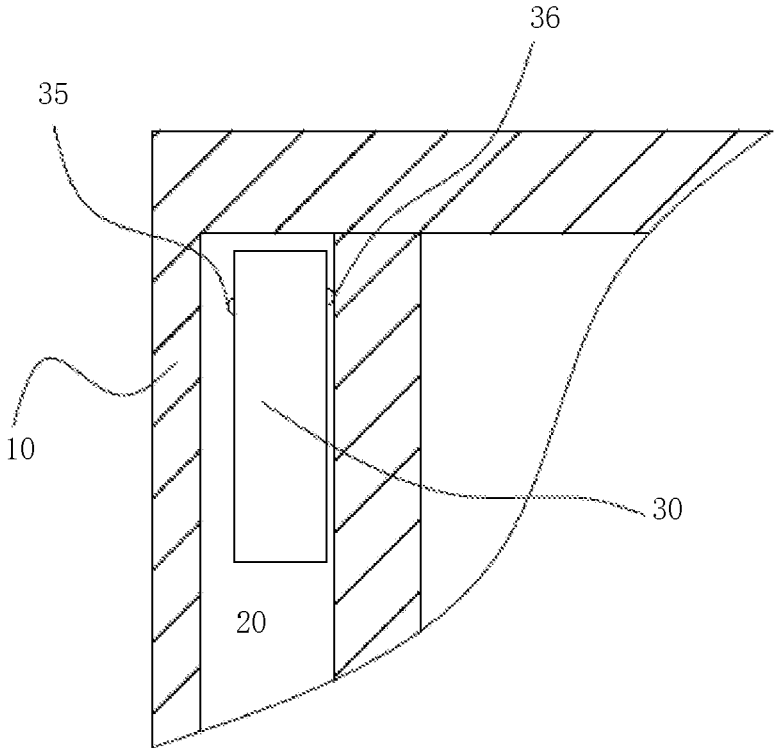
FIG. 6 is a schematic structural view of a plurality of photoelectric devices disposed on a bonding surface and a non-bonding surface of an anti-disassembly logistics appliance in a second embodiment of the present invention.

The second embodiment of the present invention relates to an anti-disassembly logistics appliance. The second embodiment is improved on the basis of the first embodiment, so that the cloud server can know the detailed status of the anti-disassembly module more finely, and then can be handled in a more targeted manner. Specifically, as shown in FIG. 6, After the anti-disassembly module 30 is installed in the confined space 20 of the logistics appliance 10, at least one surface of the anti-disassembly module 30 is as a bonding surface and bonded to one surface of the logistics appliance 10, and at least one surface is as a non-bonding surface, and is in the confined space but not bonded to any surface of the logistics appliance 10. The bonding here means that the two surfaces are in direct contact.

There are multiple photoelectric devices, at least one photoelectric device 36 is disposed on the bonding surface, and at least one photoelectric device 35 is disposed on the non-bonding surface. In FIG. 6, the bonding surface and the non-bonding surface respectively dispose only one photoelectric device. In other embodiments of the present application, the bonding surface and the non-bonding surface may respectively dispose multiple photoelectric devices.

The determining unit is used to determine whether the electrical signal output by the photoelectric device is greater than a preset threshold. If the electrical signal output by the photoelectric device disposed on the bonding surface is greater than a preset threshold, the wireless communication unit is triggered to transmit an alarm signal indicating that the anti-disassembly module is completely disengaged. If the electrical signal output by the photoelectric device disposed on the non-bonding surface is greater than a preset threshold, the wireless communication unit is triggered to transmit an alarm signal indicating that the confined space is damaged.

The third embodiment of the present invention relates to an anti-disassembly method for logistics appliance. It can be applied to the logistics appliance described in the first or second embodiment, and the method comprises:

installing an anti-disassembly module into a logistics appliance in advance so that the anti-disassembly module is disposed in a confined space structure.

The determining unit determines whether an electrical signal indicating optical intensity output by the photoelectric device is greater than a preset threshold, and if so, triggers the wireless communication unit to transmit an alarm signal, otherwise no further processing is performed (or the alarm signal is not triggered).

Wherein, the structure of the confined space satisfies the following requirements:

the confined space is an light-tight dark space after the anti-disassembly module is installed; and, during the process of disassembling the anti-disassembly module from the logistics appliance, the light-tightness of the confined space will be at least temporarily destroyed so that light can penetrate into the confined space.

In order to prevent the alarm being triggered unnecessarily during legal disassembly, a variety of improved solutions can be adopted based on the above method.

Optionally, before legal disassembly, sending an instruction indicating suspending alarm from a server to the anti-disassembly module, and prohibiting the wireless communication unit from transmitting the alarm signal after the anti-disassembly module receives the instruction.

Optionally, sending a request which carries the identification of the anti-disassembly module or the logistics appliance for legal disassembly to a server through a terminal, and ignoring the alarm signal which carries the identification of the anti-disassembly module or the logistics appliance after the server receives the request in the received alarm signal.

The implementation of each method of the present invention can be implemented in software, hardware, firmware, and the like. Regardless of whether the present invention is implemented in software, hardware, or firmware, the instruction code can be stored in any type of computer-accessible memory (e.g., permanent or modifiable, volatile or non-volatile, solid-state or non-solid, fixed or replaceable media, etc.). Similarly, the memory may be, for example, Programmable Array Logic ("PAL"), Random Access Memory ("RAM"), Programmable Read Only Memory ("PROM"), Read-Only Memory ("ROM"), Electrically Erasable Programmable ROM ("EEPROM"), magnetic disks, CDs, and Digital Versatile Discs ("DVD") and so on.

It should be noted that the units mentioned in the device embodiments of the present invention are logical units. Physically, a logical unit may be a physical unit, or may be a part of a physical unit, or multiple physical units for the combination of units, the physical implementation of these logical units is not the most important. The combination of the functions implemented by these logical units is the key to solving the technical problems proposed by the present invention. In addition, in order to highlight the innovative part of the present invention, the above device embodiments of the present invention do not introduce units that are not closely related to solve the technical problems proposed by the present invention, which does not mean that the above device embodiments do not exist other unit.

It should be noted that in the application documents of the present patent, relational terms such as first and second, etc. are only configured to distinguish one entity or operation from another entity or operation, and do not necessarily require or imply any such actual relationship or order between these entities or operations. Furthermore, the term "comprises" or "comprising" or "includes" or any other variations thereof is intended to encompass a non-exclusive inclusion, such that a process, method, article, or device that comprises a plurality of elements includes not only those elements but also Other elements, or elements that are inherent to such a process, method, item, or device. An element that is defined by the phrase "comprising a" does not exclude the presence of the same element in the process, method, item, or device that comprises the element. In the application file of this patent, if it is mentioned that an action is performed according to an element, it means the meaning of performing the action at least according to the element, and includes two cases: the behavior is performed only on the basis of the element, and the behavior is performed based on the element and other elements. Multiple, repeatedly, various, etc. expressions include 2, twice, 2 types, and 2 or more, twice or more, and 2 types or more types.

All documents referred to in this application are considered to be included in the disclosure of the present application as a whole, so as to serve as a basis for modification as necessary. In addition, it should be understood that various changes and modifications may be made by those skilled in the art after reading the above disclosure of the present application.

What is claimed is:

1. An anti-disassembly logistics appliance, comprising: a confined space and an anti-disassembly module disposed in the confined space;

the anti-disassembly module comprises: one or more photoelectric devices, a wireless communication unit and a determining unit; the determining unit is configured to determine whether an electrical signal output by the photoelectric device is greater than a preset threshold, and if so, triggers the wireless communication unit to transmit an alarm signal;

the structure of the confined space satisfies following requirements:

the confined space is a light-tight dark space after the anti-disassembly module is installed; and, during a process of disassembling the anti-disassembly module from the logistics appliance, the light-tightness of the confined space is at least temporarily destroyed to enable an optoelectronic device to detect light;

after the anti-disassembly module is installed in the confined space, at least one surface of the anti-disassembly module is used as a bonding surface to be bonded to one surface of the logistics appliance, and at least one surface of the anti-disassembly module is used as a non-bonding surface which is in the confined space but not bonded to any surface of the logistics appliance, wherein a plurality of the photoelectric devices is provided, wherein, at least one photoelectric device is disposed on the bonding surface, and at least one photoelectric device is disposed on the non-bonding surface.

2. The anti-disassembly logistics appliance according to claim 1, wherein the anti-disassembly module further comprises one or any combination of the following components electrically coupled to the wireless communication unit:

a temperature sensor, a humidity sensor, an acceleration sensor, a gyroscope, a logistics appliance empty/full sensor;

the wireless communication unit accesses an external wireless communication network in a wireless manner, and transmits signals output by the above sensors together with an identification of the anti-disassembly module to a cloud server through the wireless communication network.

3. The anti-disassembly logistics appliance according to claim 1, wherein the alarm signal comprises one of the following information or any combination thereof:

an identification of the anti-disassembly module, an identification of the logistics appliance, a time when the alarm is triggered, and a position where the alarm is triggered.

4. The anti-disassembly logistics appliance according to claim 1, wherein the anti-disassembly module comprises an independent battery to supply power to the photoelectric device, the wireless communication unit and the determining unit.

5. The anti-disassembly logistics appliance according to claim 4, further comprising a wireless charging module coupled to the battery for charging the battery.

6. The anti-disassembly logistics appliance according to claim 1, wherein the confined space is a cavity, and an inner surface of the cavity is made of a material with a reflection coefficient lower than a predetermined threshold.

7. The anti-disassembly logistics appliance according to claim 6, wherein the inner surface of the cavity is made of black matte material.

8. The anti-disassembly logistics appliance according to claim 1, wherein the determining unit is configured to trigger the wireless communication unit to transmit an alarm signal indicating that the anti-disassembly module is completely disengaged if the electrical signal output by the photoelectric device disposed on the bonding surface is greater than a preset threshold, and trigger the wireless communication unit to transmit an alarm signal indicating that the anti-disassembly module is damaged if the electrical signal output by the photoelectric device disposed on the non-bonding surface is greater than a preset threshold.

9. An anti-disassembly method for logistics appliance, comprising:

installing an anti-disassembly module into a logistics appliance in advance so that the anti-disassembly module is disposed in a confined space structure;

determining that an electrical signal indicating optical intensity output by a photoelectric device is greater than a preset threshold;

triggering a wireless communication unit to transmit an alarm signal;

wherein, the structure of the confined space satisfies following requirements:

the confined space is an light-tight dark space after the anti-disassembly module is installed; and, during a process of disassembling the anti-disassembly module from the logistics appliance, the light-tightness of the confined space is at least temporarily destroyed to enable an optoelectronic device to detect light;

after the anti-disassembly module is installed in the confined space, at least one surface of the anti-disassembly module is used as a bonding surface to be bonded to one surface of the logistics appliance, and at least one surface of the anti-disassembly module is used as a non-bonding surface which is in the confined space but not bonded to any surface of the logistics appliance, wherein a plurality of the photoelectric devices are provided, wherein, at least one photoelectric device is disposed on the bonding surface, and at least one photoelectric device is disposed on the non-bonding surface.

10. The anti-disassembly method for logistics appliance according to claim 9, further comprising:

before legal disassembly, sending an instruction indicating suspending alarm from a server to the anti-disassembly module;

prohibiting the wireless communication unit from transmitting the alarm signal after the anti-disassembly module receives the instruction.

11. The anti-disassembly method for logistics appliance according to claim 9, further comprising:

sending a request which carries an identification of the anti-disassembly module or the logistics appliance for legal disassembly to a server through a terminal;

ignoring the alarm signal which carries the identification of the anti-disassembly module or the logistics appliance after the server receives the request in the received alarm signal.

* * * * *